US005560738A

United States Patent [19]

Noel

[11] Patent Number: 5,560,738

[45] Date of Patent: Oct. 1, 1996

[54] DEPTH SENSITIVE DIVER SAFETY SYSTEM

[76] Inventor: Hector Noel, 1305 NW. 122nd Ter., Pembroke Pines, Fla. 33026

[21] Appl. No.: 400,600

[22] Filed: Mar. 8, 1995

[51] Int. Cl.[6] ..... B63C 9/15; B63C 11/22

[52] U.S. Cl. ..... 405/186; 441/96

[58] Field of Search ..... 405/185, 186; 441/88, 90, 92, 96

[56] References Cited

U.S. PATENT DOCUMENTS

| | | | |
|---|---|---|---|
| 4,176,418 | 12/1979 | Scott | 441/96 |
| 4,529,333 | 7/1985 | Robinette | 405/186 |

FOREIGN PATENT DOCUMENTS

| | | | |
|---|---|---|---|
| 4125407 | 9/1992 | Germany | 405/186 |
| 573398 | 9/1977 | U.S.S.R. | 441/96 |

*Primary Examiner*—David J. Bagnell
*Attorney, Agent, or Firm*—Malloy & Malloy, P.A.

[57] ABSTRACT

A depth sensitive diver safety system to be utilized with underwater breathing apparatus, the safety system including a first automatic ascent control stage which initiates gradual regulated inflation of a personal flotation device upon an air pressure from a pressurized air source of a user dropping to a danger/low air level corresponding a diver's depth, and a second automatic ascent control stage which is structured to initiate gradual, regulated inflation of the personal flotation device upon the diver's depth exceeding a preset safe depth level. The first automatic ascent control stage is connected in line between high and low pressure air sources such that upon a pressure exerted on a sensing piston within a main housing of the first automatic ascent control stage dropping to the danger/low air level corresponding the diver's depth, the breathable air pressure exerted by the low pressure air source on the sensing piston will be sufficient to overcome the air source pressure resulting in seepage of low pressure air into the personal flotation device for filling thereof. The second automatic ascent control stage is connected in line with the low pressure air source and includes a sensing body therein structured to be displaced upon an ambient pressure, which compresses the personal flotation device directing air into the stage, being sufficient to compress a sensing end of the sensing body until the sensing body moves to a valve displacing position that allows air flow to the personal flotation device.

22 Claims, 1 Drawing Sheet

DEPTH SENSITIVE DIVER SAFETY SYSTEM

BACKGROUND OF THE PRESENT INVENTION

1. Field of the Invention

The present invention relates to a depth sensitive diver safety system to be utilized by scuba divers in order to actively reduce the likelihood that a diver will inadvertently descend beyond an acceptable depth limit for the diver, or run out of air while beneath the water's surface.

2. Description of the Related Art

Scuba diving is a widely enjoyed recreational activity which while it can facilitate a variety of enjoyable activities such as, hunting, photography and exploration, has many attended dangers associated therewith. Fortunately, most common dangers associated with scuba can be avoided if appropriate care is taken. The most common avoidable dangers associated with diving are generally related to the limited air supply carried by a diver and the hazards associated with exceeding acceptable depth limitations for the diver.

Usually, the diver's air supply is contained entirely within one or more pressurized tanks carried on the back of the diver. Further, while the size and type of tank is the important factor in determining the amount of air which a diver has available for use beneath the water, it is the individual diver's rate of consumption which determines the amount of time for which a diver can stay under water.

A diver's rate of consumption will primarily be affected by the individual diver's physical attributes and level of activity, as well as the depth at which the diver is swimming. Specifically, as the swimming depth of a diver increases, the increased pressure at the depth, and particularly the increased pressure at which the breathable air is being supplied to the diver, will substantially increase such that a larger quantity of air will be drawn into the diver from the tank with every breathe. As such, a diver with the same equipment and breathing rate as a diver who remains closer to the surface will run out of air substantially faster due to the larger amounts of air being drawn in. Further, not only will the diver at depth run out of air faster, but this same diver will also require more time to ascend and therefore more air in order to properly return to the surface.

The need for a diver to properly and preferably slowly return to the surface when scuba diving is extremely important to ensure that a variety of possibly serious problems do not occur. One such problem is the risk of a pulmonary embolism which can result if a diver ascends too rapidly without appropriately exhaling and releasing expanding air from his lungs, as often happens in a panic situation after a diver begins to run low or is out of air. Specifically, at increased depth, the pressure is greater and the air within the lungs is compressed, but as the diver surfaces that air considerably expands and must constantly be released. For example, the volume occupied by a quantity of air at thirty-three (33) feet below the surface is only half of the volume occupied by the same quantity of air at the surface. Therefore, divers must ascend at a relatively slow rate and during deeper diving make equalizing stops along the way, all of which requires greater quantities of reserved air to arrive at the surface when the diver is deeper and the air tank begins to run low of air.

Presently, most divers will utilize various gauges which indicate the air pressure remaining in the tanks, and to ensure safety they are instructed to check those gauges frequently in order to detect a low air supply. Nonetheless, when divers become involved in various activities beneath the water, many of which will not only divert their attention but will also increase their rate of air consumption, they can loose track of time and a rate of air depletion, therefore not realizing that they are low on air until it is dangerously late. This is particularly the case in underwater rescue operations wherein rescue divers are involved in strenuous operations. Further, even if a diver wanted to check the gauges frequently, if it is dark, they are swimming in silty water or visibility conditions are otherwise impaired it is often impossible or very difficult to effectively check the gages.

In the past, other types of valve mechanisms known as "J" valves had been implemented in an attempt to increase safety. These "J" valves, which are now rarely utilized due to dangerous design problems, were generally designed to maintain a constant 300 psi air reserve available to a user if air runs low. The "J" valves, however, maintain a constant reserve and do not provide the greater reserve of air which will be required at a greater depth. Also, J valves act passively and necessitate that the diver be aware of the danger and perform some often difficult manipulations in order to implement the reserve and surface. Therefore, their is still a substantial need in the art for a system which incorporates a device that even when the diver is distracted and unaware of their current air circumstance, or even unconscious, will actively and effectively function to alert the diver and act to ensure that the diver returns to the surface with sufficient air. In particular, it is necessary to have such a device which determines when the diver is running low on air, in accordance with the depth of the diver, thereby ensuring that a sufficient reserve to correspond safe surfacing from the diver's depth is maintained, while also actively causing the diver to gradually begin surfacing to safety.

Another major diving concern and a frequent reason for diving accidents and deaths is the depth at which a diver swims. Specifically, individuals underneath the water's surface absorb oxygen and nitrogen into their body after prolonged periods of breathing air regulated to be breathable at substantial depths. Pure oxygen, as used in military rebreather units, if absorbed at only 33 feet causes oxygen poisoning, seizures, unconsciousness and probably death. Nitrogen, when introduced to the body, can also lead to some dangerous situations, namely, nitrogen narcosis and decompression sickness, often referred to as the bends.

Nitrogen narcosis primarily involves a drunken state which the diver enters when a safe depth is exceeded without an appropriate air mixture, and can result in poor judgment, disorientation or unconsciousness. Accordingly, a diver affected by nitrogen narcosis may not recognize that they are running low on air and/or may act recklessly and dangerously doing things such as swimming even deeper, and/or removing their mask, regulator and/or air tanks. Although dangerous, nitrogen narcosis is also very easily prevented if a diver maintains appropriate depth levels. Further, if nitrogen narcosis symptoms are experienced a diver must merely swim to a shallower depth to regain normal cognoscence.

Regarding the bends, it results from prolonged exposure at substantial depth without taking proper preventive safety measures, and primarily involves the accumulation of excess nitrogen in the body. Specifically, at depth extra nitrogen is absorbed by the body. This extra nitrogen, which exits the body gradually, must not exceed acceptable limits within the body or serious trauma can occur. Generally, this problem is avoided through the diver's use of various charts and tables which help calculate the maximum safe duration for a dive at a particular depth. Unfortunately, however, divers involved in certain activities such as hunting or exploring may lose track of their depth and may accidently descend to a deeper area which disrupts their calculations regarding the maximum duration of the dive. The erroneous calculations may not only cause problems to the diver on that particular dive, but if they plan to make a series of dives can lead to problems on a future dive, even if that future dive is a relatively shallow dive.

As such, it would be highly beneficial in circumstances of oxygen poisoning, nitrogen narcosis and decompression sickness, to provide a diver safety system which will actively function to prevent a diver from exceeding an appropriate preset swimming depth. Such a device could function to ensure that the maximum depth limits, which are set for very important safety reasons, are maintained, and if a diver inadvertently or intentionally exceeds those limits, that active steps will be taken to gradually return the diver to an appropriate depth. The device of the present invention is designed specifically to meet the needs present in this specialized art through a system that can be easily incorporated and/or built into existing scuba equipment in order to eliminate some degree of human error involved in many dive accidents and deaths. Presently, the devices known in the art merely enable only conscious, level headed divers to be alerted of potentially hazardous conditions, but do not function actively to prevent a diver who does not notice, or care about these alarms from inadvertently exceeding appropriate depths and air limits.

SUMMARY OF THE INVENTION

The present invention is directed to a depth sensitive diver safety system to be utilized with a scuba system. The scuba system will preferably be of the type which includes at least one pressurized air source with at least one air outlet at which a high/low pressure regulator is secured. The high/low pressure regulator will be structured to provide at least one high pressure air source and at least one low pressure air source for use by the diver. The low pressure air source is utilized to supply air at a breathable pressure corresponding a diver's depth. Further, the scuba system should include an inflatable personal flotation device.

Turning specifically to the diver safety system, it includes primarily a first automatic ascent control stage and a second automatic ascent control stage which can be built into one housing or two separate housings. The first automatic ascent control stage will be structured to initiate inflation of the personal floatation device upon an air pressure from the pressurized air source dropping to a danger/low air level corresponding the diver's depth. Included in the first automatic ascent control stage is a main housing. The main housing has a high pressure end and a low pressure end, and a surrounding side wall defining an open interior. Similarly, the open interior includes a high pressure side and a low pressure side. Connected at the high pressure end of the main housing so as to permit high pressure air flow into the high pressure side of the open interior is the high pressure air source. Similarly, secured at the low pressure end of the main housing so as to permit low pressure air flow into the low pressure side of the open interior is the low pressure air source.

Disposed in the surrounding wall of the main housing is a filler outlet. The filler outlet is specifically positioned so as to be in fluid flow communication between the low pressure side of the open interior of the main housing and a fill air conduit. The fill air conduit is connected in fluid flow communication with the personal floatation device such that air which is permitted to exit the main housing through the filler outlet will gradually pass through the fill air conduit and fill the personal flotation device resulting in an ascent by the diver.

Slidably disposed within the open interior of the main housing is a sensing piston. The sensing piston includes a high pressure stem and a low pressure face and is structured to move within the open interior between a fill flow stopping orientation and a fill flow permitting orientation. Specifically, when the sensing piston is in the fill flow stopping orientation air is prevented from flowing into the filler outlets, and when the sensing piston is in the fill flow permitting orientation air is permitted to enter the filler outlet and therefore flow through the filler air conduit to the personal flotation device. Positioned between the sensing piston and the high pressure end, so as to correspond slided movement of the sensing piston, is a fluid impermeable, resilient material seal. This resilient material seal is positioned so as to separate the high pressure air flow and the low pressure air flow within the open interior of the main housing. The sensing piston in the open interior of the main housing is positioned such that the low pressure air flow directed into the low pressure side of the open interior will urge the sensing piston into the fill flow permitting orientation while the high pressure air flow into the high pressure side of the open interior will urge the sensing piston into the fill flow stopping orientation. Further, the main housing and sensing piston of the first automatic ascent control stage is structured such that when the air pressure from the pressurized air source is above the danger/low air level corresponding the diver's depth, the breathable pressure, corresponding the diver's depth, which is exerted on the sensing piston by the low pressure air flow will be insufficient to overcome a pressure, corresponding the air pressure from the pressurized air source, exerted on the sensing piston by the high pressure air flow. When, however, the air pressure from the pressurized air source drops below the danger/low air level, corresponding the diver's depth, the breathable pressure, corresponding the diver's depth, which is exerted on the sensing piston by the low pressure air flow is sufficient to overcome the pressure, corresponding the air pressure from the pressurized air source, exerted on the sensing piston by the high pressure air flow, thereby initiating movement of the sensing piston to the fill flow permitting orientation and enabling air to exit the main housing and flow into the personal flotation device.

The second automatic ascent control stage of the diver safety system is structured to initiate gradual, regulated inflation of the personal flotation device when the diver's depth exceeds a preset safe depth level. This second automatic ascent control stage includes a primary housing having an air inlet, an air outlet, and a regulator chamber defined therein. The regulator chamber itself includes an exterior pressure area and an interior flow through area.

Disposed between the air inlet and the interior flow through area of the regulator chamber is an inlet access having displaceable valve means disposed therein. The displaceable valve means are structured to move between a flow through orientation, wherein air is permitted to pass from the air inlet into the interior flow through area of the regulator chamber, and a flow prevention orientation, wherein air is prevented from passing from the air inlet into the interior flow through area of the regulator chamber.

Positioned within the regulator chamber and structured to move between a valve displacing position and an unengaging position is a sensing body. When the sensing body is in the valve displacing position the displaceable valve means are urged into the flow through orientation thereby. Similarly, when the sensing body is in an unengaging position the displaceable valve means remain in the flow preventing orientation. The sensing body itself includes a compensating end and a sensor end. The compensating end is positioned within the exterior pressure area of the regulator chamber and the sensor end is disposed within the interior flow through area of the regulator chamber.

Further, disposed about the sensing body and structured to prevent fluid flow between the exterior pressure area of the regulator chamber and interior flow through area of the regulator chamber are seal means. The seal means are liquid impervious and prevent fluid flow therethrough while still permitting slided movement of the sensing body.

Connected in fluid flow communication with the air outlet of the primary housing is the personal flotation device. Accordingly, when air flows into the interior flow through area of the regulator chamber through the inlet access, it is directed into the personal flotation device. Similarly, however, as the diver's depth increases, the exterior pressure exerted on the personal flotation device causes an increased pressure in the interior flow through area which affects the sensing body. Specifically, the sensing body is structured and disposed such that the increases pressure in interior flow through area of the regulator chamber will urge the sensing body into the valve displacing position. The sensor end of the sensing body, however, is structured to resist movement of the sensing body into the valve displacing position. In particular, the sensor end is structured to gradually compress upon the pressure in the internal flow area of the regulator chamber exceeding a resistance air pressure of the sensor end. Accordingly, when the outside pressure corresponding a diver's depth reaches a predetermined maximum depth pressure, which corresponds the preset safe depth level, the sensor end will have compressed sufficiently such that the sensing body is disposed in the valve displacing position, allowing air to fill the personal flotation device.

It is an object of the present invention to provide a depth sensitive diver safety system which will actively ensure that a diver does not recklessly or accidentally exceed preset, safe depth limitations.

Another object of the present invention is to provide a depth sensitive diver safety system which will provide an active and accurate indication of a diver's remaining air supply.

Yet another object of the present invention is to provide a depth sensitive diver safety system which will provide an active and accurate indication that a diver's air supply is running low which corresponds a depth of the diver, thereby functioning to provide a diver at greater depths with a greater reserve than at shallow depths.

An additional object of the present invention is to provide a depth sensitive diver safety system which includes safety means that indicate a diver is running low on air which can be built directly into existing regulator systems to provide the depth sensitive low air recognition.

Still another object of the present invention is to provide a system which will actively function to initiate a gradual ascent of an unaware or unconscious diver if the diver runs low on air or exceeds safe depth limitations.

Another object of the present invention is to provide a system that will 1) reduce accidents and deaths, 2) reduces liability risks during diving tours and multi-student open water instructions, and 3) raises rescue and military effectiveness and safety.

BRIEF DESCRIPTION OF THE DRAWINGS

For a fuller understanding of the nature of the present invention, reference should he had to the following detailed description taken in connection with the accompanying drawings in which.

Like reference numeral refer to like parts throughout the several views of the drawings.

DETAILED DESCRIPTION OF THE PREFERRED EMBODIMENT

Figure 1:
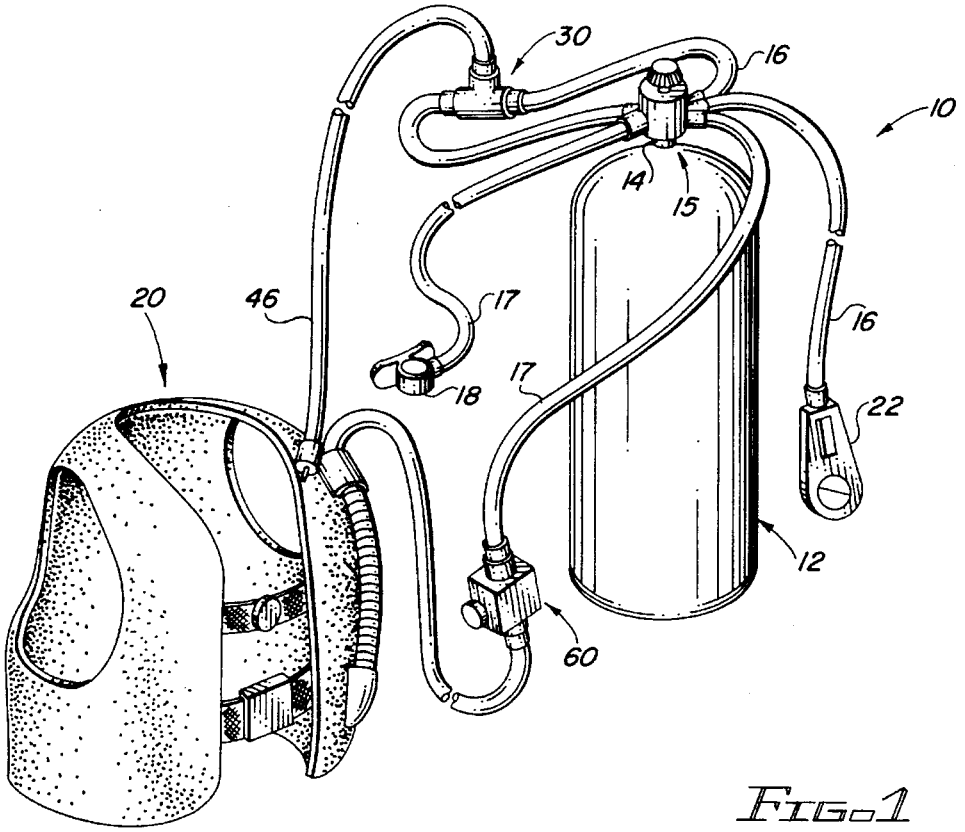
FIG. 1 is a perspective view of the depth sensitive diver safety system of the present invention.
Figure 2:
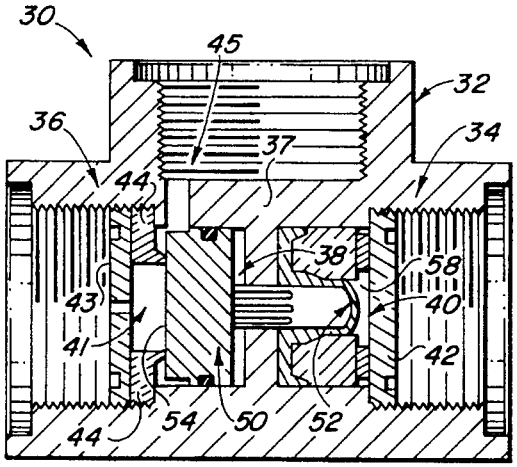
FIG. 2 is a cross sectional view of the first automatic ascent control stage of the present invention.
Figure 3:
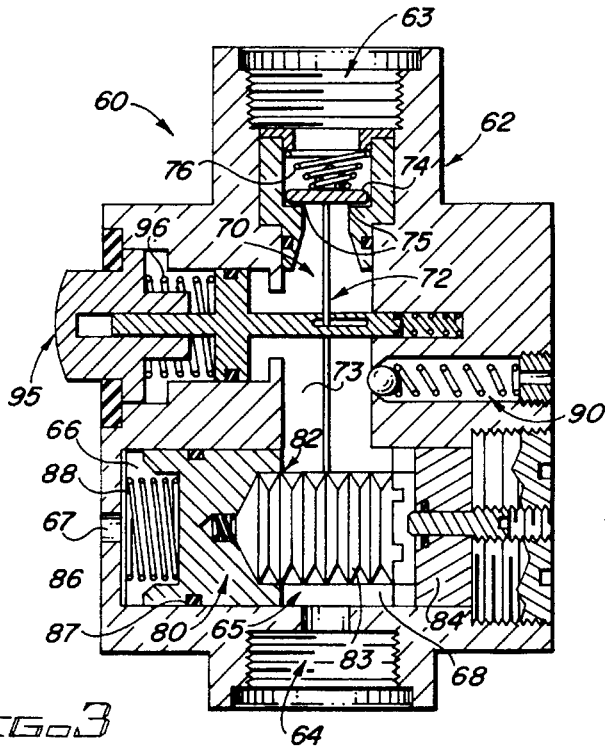
FIG. 3 is a side cross sectional view of the second automatic ascent control stage of the present invention.

Shown throughout the Figures, the present invention is directed towards a depth sensitive diver safety system, generally indicated as 10, which preferably includes two stages. The diver safety system 10, which includes primarily a first automatic ascent control stage 30 and a second automatic ascent control stage 60 therein, is primarily structured for use with a scuba system of the type which includes at least one pressurized air source 12, a high/low pressure regulator 15 and an inflatable personal flotation device 20. Specifically, conventional scuba systems will include at least one and possibly more pressurized air tanks 12 having at least one air outlet 14. Secured at that air outlet 14 is the high/low pressure regulator 15. The high/low pressure regulator 15 is structured to provide a plurality of air sources for use in the various articles of scuba equipment carried by a diver. In particular, the high/low pressure regulator 15 must include at least one high pressure air source 16 and one low pressure air source 17. Generally, however, most regulators 15 include a high pressure air source 16, to be connected with the variety of meters and gauges 22 which indicate a quantity of air remaining in the pressurized air tank 12, and a plurality of low pressure air sources 17 leading to various necessary articles such as the second stage 18, through which the diver breathes, alternative second stages, and the personal flotation device 20. The low pressure air source 17 is structured such that air will be supplied at a breathable pressure corresponding a diver's depth. Specifically, as a diver descends beneath the water's surface, the breathable pressure corresponding the diver's depth will increase. Similarly, as the diver ascends to the surface the breathable pressure will decrease. Generally, this same breathable pressure is the pressure at which all of the low pressure air sources 17 exiting the regulator 15 are maintained.

Connected in line with both a high pressure and low pressure air source 16 and 17 exiting the regulator 15 is a first automatic ascent control stage 30. This first automatic ascent control stage 30 is specifically structured to initiate inflation of the personal flotation device 20 upon an air pressure within the pressurized air tank 12 dropping to a danger/low air level corresponding the diver's depth. Specifically, as the diver descends further beneath the water's surface he/she will naturally require greater quantities of air to safely return to the water's surface. Additionally, at greater depths, the pressure is greater such that air will be drawn from the pressurized air tank 12 by the diver at a much more rapid rate than at shallower depths thereby also necessitating additional air if the diver will be able to safely return to the water's surface.

Included in the first automatic ascent control stage 30 is a main housing 32. The main housing 32 includes a high pressure end 34, a low pressure end 36 and a surrounding side wall 37 which defines an open interior 38 of the main housing 32. The open interior 38 of the main housing 32 includes a high pressure side 40 and a low pressure side 41 corresponding the air source connections. In particular, the main housing 32 will be secured to the high pressure air source 16 at the high pressure end 34 such that high pressure air flow from the high pressure air source 16 will enter the high pressure side 40 of the open interior 38 of the main housing 32. Similarly, the low pressure air source 17 will be secured to the main housing 32 at the low pressure end 36 so as to permit low pressure air flow from the low pressure air source 17 into the low pressure side 41 of the open interior 38.

Also included in the main housing 32 is a filler outlet 45. The filler outlet 45 is disposed in the surrounding side wall 37 of the main housing 32 and is positioned so as to be in fluid flow connection between the low pressure side 41 of the open interior 38 of the main housing 32 and a fill air conduit 46 which is preferably external to the main housing 32. In addition to being connected in fluid flow communication with the filler outlet 45, the fill air conduit 46 is connected in fluid flow communication with the personal flotation device 20 such that air which is permitted to exit the main housing 32 through the filler outlet 45 will pass through the fill air conduit 46 and gradually fill the personal flotation device 20. This gradual filling of the personal flotation device 20 will therefore result in a gradual ascent by the diver which serves as a warning to the diver they are running low on air.

Seated within the open interior 38 of the main housing 32 is a sensing piston 50. The sensing piston 50 includes a high pressure stem 52 disposed towards the high pressure side 40 of the open interior 38, and a low pressure face 54 disposed towards the low pressure side 41 of the open interior 38. Preferably, the sensing piston 50 will have a generally T-shaped configuration such that a contact surface of the low pressure face 54 will be larger than a contact face of the high pressure stem 52. The sensing piston 50 is slideably disposed within the open interior 38 of the main housing 32 such that it can move freely therein in accordance with pressure variations affecting the open interior 38. Specifically, the sensing piston 50 is structured to move between a fill flow stopping orientation wherein the sensing piston 50 blocks the filler outlet 45, and a fill flow permitting orientation wherein the sensing piston 50 is disposed to expose the filler outlet 45 such that air can freely flow from the low pressure side 41 of the open interior 38 into the filler outlet 45.

Positioned between the sensing piston 50 and the high pressure side 40 of the open interior 38 is a fluid impermeable, resilient material seal 58. The resilient material seal 58 is preferably a silicone nipple type seal, and will be positioned in a static orientation within the open interior 38. Preferably, the material seal 58 will be structured such that it will not move laterally within the open interior 38, but rather material compression thereof will result to correspond slided movement of the sensing piston 50. For example, if a greater pressure is exerted from the high pressure side 40 of the open interior 38, the resilient material seal will compress toward the low pressure side and therefore the sensing piston 50 will move towards the fill flow stopping orientation. If, however, a greater pressure is being exerted on the sensing piston 50 from the low pressure side 41 of the open interior 38, the sensing piston 50 will move towards the high pressure side 40, compressing the resilient material seal 58, and resulting in the sensing piston 50 sliding to the flow permitting orientation. Preferably, the resilient material seal 58 includes a generally top hat type configuration so as to be disposed substantially over the high pressure stem 52 of the sensing piston 50. Further a flanged or brim end of the resilient material seal 58 is securely seated within the main housing 32 so as to preferably separate the high pressure side 40 from the low pressure side 41 and prevent slided movement of the resilient material seal 58. Alternatively, a gasket or O-ring type seal can be utilized about the sensing piston 50, but in the preferred embodiment the top hat type seal is utilized such that the sensing piston 50 is permitted to more freely slide within the open interior 38 without risk of material failures or having to overcome the frictional force exerted by an O-ring on the main housing 32. In addition the preferred embodiment results in a structurally supported seal which becomes resistant to tears, rips or blow outs common to O-rings or diaphragms under extreme pressure. With this top hat design, no special skills, tools, or high pressure O-ring compression fixtures are required for maintenance, replacement, or repair of parts.

Additionally, the preferred top hat embodiment of the resilient material seal 58 is self lubricating during each cycle of movement. In use a small quantity of lubricating grease is applied within the low pressure side 41 of the open interior 38 behind the low pressure face of the sensing piston 50 such that when the sensing piston 50 moves towards the high pressure side of the open interior 38, the lubricant positioned therein is squeezed over the high pressure stem of the sensing piston 50, unlike an O-ring which eventually may rub a dry spot in a cylinder wall such that the O-ring does not slide freely and is susceptible to failure. Also, a seal such as a low pressure O-ring may be provided about the low pressure face of the sensing piston 50 to maintain the lubricant in the proper place.

When functioning, the first automatic ascent control stage 30 receives a high and low pressure input and thereby is able to determine when the diver's air supply is running low. In particular, the high pressure end 34 of the main housing 32 preferably includes a high pressure wall 42 which allows regulated quantities of high pressure air flow therethrough. This high pressure air flow will tend to move the sensing piston 50 towards its normal, fill flow stopping orientation due to a pressure corresponding the air pressure within the pressurized air tank 12 which is exerted on the sensing piston 50 by the high pressure air flow entering through the high pressure end 34 of the main housing 32. Similarly, the low pressure end 36 of the main housing 32 will include a low pressure wall 43 so as to allow regulated quantities of low pressure air flow into the low pressure side 41 of the open interior 38. Normally, when the air pressure in the pressurized air tank is above the danger/low air level corresponding the diver's depth, the pressure exerted thereby will be sufficient to overcome the breathable pressure corresponding the diver's depth which is exerted on the sensing piston 50 by the low pressure air flow into the low pressure side 41 of the open interior 38. As, however, the air pressure within the pressurized air tank 12 drops, the effects of the breathable pressure corresponding the diver's depth as asserted by the low pressure air flow is increased. Eventually, upon the air pressure in the pressurized air tank dropping below the danger/low air level corresponding the diver's depth, the breathable air pressure corresponding the diver's depth, as exerted by the low pressure air flow, is be sufficient to slide the sensing piston 50 towards the high pressure side 40 thereby moving the sensing piston 50 into the fill flow permitting orientation and allowing air to filter through the filler outlet 45 to the personal flotation device 20.

In addition to the mere pressure drop within the pressurized air tank 12 affecting movement of the sensing piston 50, as the depth of the diver increases the breathable pressure also increases. This breathable air pressure increases primarily as a result of the addition of the normal low pressure flow with the increased pressure at depth. Accordingly, at greater depth the level to which the air pressure within the pressurized air tank must drop before the breathable air pressure exerted by the low pressure air source is sufficient to overcome it increases resulting in a greater quantity of air remaining within the pressurized air tank upon the air beginning to flow into the personal flotation device 20 from the filler outlet 45.

Preferably, the danger/low air level is set to about 300 psi at the surface, and will progressively become greater as the depth increases. This danger/low air level is determined and set primarily as a result of the relationship between the size of the contact face of the low pressure side 54 of the sensing piston 50 and the size of the contact area of the high pressure stem 52 of the sensing piston 50. As an additional control, a low pressure seat 44 may be included at the low pressure side 41 of the open interior 38. When the sensing piston 50 is in its normal fill flow preventing orientation the low pressure face 54 will be seated in abutting relation with the low pressure seat 44. Accordingly, by replacing the low pressure seat 44 and varying an opening provided thereby, the amount of contact area over which the low pressure flow exerts the breathable air pressure on the sensing piston 50 is varied thereby allowing further control of the danger/low air level appropriate for the particular diver. In one embodiment of the present invention, the first automatic ascent control stage 30 will be mounted exterior of the regulator 15, either integrally or separately from the second automatic ascent control stage 60. Accordingly, the regulator 15 may include separate high and low pressure air sources 16 and 17 specifically for the purpose of use with the first automatic ascent control stage 30, or, the existing high and low pressure conduits can be tapped to provide the necessary high and low pressure air flows. Alternatively, the first automatic ascent control stage 30 can be build directly into the regulator 15 and the regulator 15 will also include the exteriorly exposed filler outlet 45 from which the fill air conduit 46 is directed to the personal flotation device 20. Further, the fill air conduit 46 will preferably be secured to an independent inlet in the personal flotation device 20, however, alternative connections may be equally effective so long as air flow enters the personal flotation device 20 to initiate its inflation.

Additionally included in the depth sensitive diver safety system 10 is the second automatic ascent control stage 60. The second automatic ascent control stage 60 is structured so as to initiate gradual, regulated inflation of the personal flotation device 20 when the diver's depth exceeds a preset safe depth level. This second automatic ascent control stage 60 is connected in line with the low pressure air source 17, either integrally or separately from the first automatic ascent control stage 30, and can alternatively be connected at and/or replace the conventional inflator connections of the personal flotation device 20.

Specifically, the second automatic ascent control stage 60 includes a primary housing 62 having an air inlet 63, an air outlet 64 and a regulator chamber 65. The regulator chamber 65 within the primary housing 62 is preferably divided into an exterior pressure area 66 and an interior flow through area 68. Disposed in fluid flow connection between the air inlet 63 and the interior flow through area 68 of the regulator chamber 65 is an inlet access 70. The inlet access 70 is positioned such that air flow entering the air inlet 63 is directed therethrough into the interior flow through area 68 of the regulator chamber 65. Additionally, disposed at the inlet axis 70 are displaceable valve means 72. The displaceable valve means 72 are specifically structured so as to move between a flow through orientation and a flow prevention orientation. The flow through orientation is structured to permit air to pass from the air inlet 63 to the interior flow through area 68 of the regulator chamber 65, and the flow prevention orientation is structured to prevent any air from passing from the air inlet 63 into the interior flow through area 68 of the regulator chamber 65. Although the displaceable valve means 72 can take on any of a variety of configurations which include a flow though orientation and a flow prevention orientation, the preferred embodiment of the displaceable valve means 72 includes a tilt valve. Preferably, this tilt valve 72 includes an elongate displacement pin 73 and a seal head 74. The seal head 74 of the tilt valve 72 is structured to be positioned upon a valve seat 75 formed in the air inlet 63 of the primary housing 62. This valve seat 75 is structured so as to supportably hold the seal head 74 thereon without air flow passing therethrough when the tilt valve 72 is disposed in its normal flow prevention orientation. Additionally, a biasing member, preferably in the form of a coil spring 76 is connected between the seal head 74 and the primary housing 62. This spring 76 functions to maintain the seal head 74 properly positioned in the flow prevention orientation unless the displacement pin 73 is displaced resulting in movement of the tilt valve 72 to the flow permitting orientation.

Once air is allowed to flow into the interior flow through area 68 of the regulator chamber 65 it exits the primary housing 62 through the air outlet 64. This air outlet 64 is connected in fluid flow communication with the personal flotation device 20 thereby directing air passing through the primary housing 62 into the personal flotation device 20 in order to inflate it. Additionally, upon compression of the personal flotation device 20 as the diver descends, the residual air therein will back up into the regulator chamber.

Positioned within the regulator chamber 65 and structured to move between a valve displacing position and an unengaging position is a sensing body 80. The sensing body 80 is structured such that when in the valve displacing position it contacts and therefore displaces the displacement pin 73 of the tilt valve 72 so as to result in air flow from the air inlet 63 into the interior flow through area 68. Conversely, when in the unengaging position, preferably its normal position, the displacement pin 73 of the tilt valve 72 will not be displaced and no air flow enters the interior flow through area 68 of the regulator chamber 65.

The sensing body 80 includes a sensor end 82 and a compensating end 86. The compensating end 86 is disposed in the exterior pressure area 66 of the regulator chamber 65. Further, seal means, preferably in the form of an O-ring 87, but alternatively in the form of any fluid impervious seal are disposed at and preferably about the sensing body 80 so as to prevent fluid flow between the exterior pressure area 66 and the interior flow through area 68 of the regulator chamber 65. Disposed within the primary housing 62 so as to permit exterior fluid flow into and out of the exterior pressure area 66 is an exterior pressure inlet 67, which can be covered by a filter to prevent foreign partial build up. The exterior pressure inlet 67 is open to ambient pressure conditions such upon lateral movement of the sensing body 80, and accordingly variations in the size of the exterior pressure area 66, excess fluid can exit and additional fluid can enter to eliminate any vacuum effects were the exterior pressure area completely sealed.

Accordingly, in use, as a diver's depth increases, the personal flotation device 20 compresses more and more resulting in an increased pressure within interior flow through area 68 of the regulator chamber 65. As a result, when the pressure increases within the interior flow through area 68 of the regulator chamber 65, due to depth and therefore outside pressure increases, the sensing body 80 is structured to be gradually urged into the valve displacing position.

Specifically, the sensor end 82 of the sensing body 80 is disposed in the interior flow through area 68 of the regulator chamber 65 and is specifically structured to resist movement of the sensing body 80 towards the valve displacing position. In the preferred embodiment, the sensor end 82 is structured to gradually compress when pressure in the interior flow through area 68 of the regulator chamber 65 exceeds a resistance air pressure, which in the preferred embodiment is sea level air pressure. Accordingly, upon the outside pressure corresponding the diver's depth reaching a maximum depth pressure, which corresponds the preset safe depth level, the sensor end 82 will have sufficiently compressed such that the sensing body 80 will finally have moved into the valve displacing position and air flow is permitted into the interior flow through area 68 of the regulator chamber 65. In the preferred embodiment, the sensor end 82 will include an accordion type configuration which defines an interior fluid bladder 83. This interior fluid bladder 83 is sealed and filled with air or another fluid at ambient pressure. Therefore, when the depth of the diver increases, the increased pressure will cause the fluid within the interior fluid bladder 83 of the sensor end 82 to become more dense, reducing its volume and allowing compression of the sensor end 82 under the force of the pressure within the interior flow through area 68 of the regulator chamber 65. The depth at which such displacement of the sensing body 80 into the valve displacing position takes place is determined by the dimensions of the sensing body 80 and a portion thereof which will abut the displacement pin 73, as well as by an original surface level volume within the sensor end 82. Further, an adjustment screw 84, which is exteriorly assessable from the primary housing 62, is also included to permit necessary adjustment. This air tight screw 84 can be used to enable necessary adjustment and calibration to correspond the needs of a particular diver.

By gradually inflating the personal flotation device in small, regulated quantities, the diver is gradually "tugged" to a safer depth. Further, if diving at an unsafe depth persists, gradual ascending will take place. Such is specially useful in situations wherein the diver is involved in activities such as hunting or photography wherein they loose track of a current depth being maintained. Also, due to the significant hazards involved with exceeding depth limitations, divers are instructed to plan their dives to maximum depth limitations. Accordingly, if these maximums depth limitations are exceeded all calculations which have been made to ensure their safety become erroneous leading to hazardous conditions on a next dive if the depth and duration of the current dive, which had previously been acceptable, become unacceptable due to the exceeded depths on the original dive.

In the preferred embodiment, the sensing body 80 will be structured such that when it first contacts the displacement pin 73 to begin air flow into the interior flow through area 68, the air outlet 64 will be relatively open, but as the displacement pin 73 is further displaced to allow greater quantities of air to flow into the interior flow through area 68 the air outlet 64 will become progressively less open. Accordingly, the personal flotation device 20 will not fill too rapidly.

Additionally in the preferred embodiment, the exterior pressure area 66 includes added biasing means 88 disposed therein. The added biasing means 88 are preferably in the form of a spring and are specifically structured to provide enough biasing force on the sensing body 80 to compensate for the frictional resistance provided by the seal means 87 and the personal flotation back pressure and breaking pressures of the tilt valve.

In order to prevent overfilling and possibly rupture of the personal flotation device, the second automatic ascent control stage 60 is structured to automatically shut off. Specifically, when the personal flotation device 20 becomes filled, air will completely back up into the interior flow through area 68, overcoming the biasing means 88 and urging the sensing body 80 back into the unengaging position. Further, as an additional feature the second automatic ascent control stage 60 can also include an overflow outlet 90. The overflow outlet 90 will preferably be a typical overflow valve including an outflow stopper held in place by biasing means, such as a spring, unless sufficient overflow air is present to overcome the force of the biasing means. The overflow outlet 90 is structured to release the excess air after full inflation of the personal flotation device 20 and upon the expansion of the air within the personal flotation device 20 when the diver ascends and the exterior pressure exerted on the personal flotation device 20 is reduced. Accordingly, in order to avoid rupturing of the personal flotation device 20, the overflow outlet 90 permits this extra air to escape as the diver's depth decreases.

Further, the second automatic ascent control stage 60 may merely be connected in line with the low pressure air source 17 which normally directs low pressure air flow to the personal flotation device, can be built integrally with the first automatic ascent control stage 30, or can be build directly into the inflation means or handle of existing personal flotation device designs. Particularly when built in, the second automatic ascent control stage 60 will also include a manual inflate bypass pin 95 which is exteriorly assessable and held in an unengaged position by a spring 96. When a diver wishes to automatically inflate the personal flotation device 20, they must merely push the inflate pin 95, which extends into the inlet axis 70, so as to push and therefore displace the displacement pin 73 of the tilt valve 72. As such, pressurized air is allowed to freely flow into the personal flotation device 20 while the inflate pin 95 is pressed. Additionally, the inflate pin 95 is structured and disposed such that when the personal flotation device 20 is filled, a pressure exerted thereon from the interior flow through are 68 will prevent movement of the inflate pin 95 to overinflate the personal flotation device 20.

While this invention has been shown and described in what is considered to be a practical and preferred embodiment, it is recognized that departures may be made within the spirit and scope of this invention which should, therefore, not be limited except as set forth in the claims which follow and within the doctrine of equivalents.

Now that the invention has been described,

What is claimed is:

1. A depth sensitive diver safety system to be utilized with a scuba system including: (i) at least one pressurized air source having at least one air outlet, (ii) a high/low pressure regulator secured at the air outlet of the pressurized air source so as to provide at least one high pressure air source and at least one low pressure air source, the low pressure air source being structured to supply air at a breathable pressure corresponding a diver's depth, and (iii) an inflatable personal flotation device; said depth sensitive diver safety system comprising:

(a) a first automatic ascent control stage structured to initiate inflation of the personal flotation device upon an air pressure from the pressurized air source dropping to a danger/low air level corresponding the diver's depth, said first automatic ascent control stage comprising:

a main housing, said main housing including a high pressure end, a low pressure end, and a surrounding side wall defining an open interior, said open interior including a high pressure side and a low pressure side, said main housing being secured to the high pressure air source at said high pressure end so as to permit high pressure air flow from said high pressure air source into said high pressure side of said open interior, said main housing being secured to the low pressure air source at said low pressure end so as to permit low pressure air flow from said low pressure air source into said low pressure side of said open interior, a filler outlet disposed in said surrounding wall of said main housing, said filler outlet being disposed in fluid flow communication between said low pressure side of said open interior of said main housing and a fill air conduit, said fill air conduit being connected in fluid flow communication with the personal flotation device such that air permitted to exit said main housing through said filler outlet gradually fills the personal flotation device resulting in an ascent by the diver, a sensing piston including a high pressure stem and a low pressure face, said sensing piston being slidably disposed within said open interior of said main housing and being structured to move between a fill flow stopping orientation, wherein air is prevented from flowing into said filler outlet, and a fill flow permitting orientation, wherein air is permitted to enter said filler outlet, a fluid impermeable, resilient material seal disposed between said sensing piston and said high pressure end, said sensing piston being disposed in said open interior of said main housing such that said low pressure air flow into said low pressure side of said open interior urges said sensing piston into said fill flow permitting orientation and said high pressure air flow into said high pressure side of said open interior urges said sensing piston to said fill flow stopping orientation, and said main housing and said sensing piston of said first automatic ascent control stage being structured such that upon the air pressure in the pressurized air tank being above said danger/low air level corresponding the diver's depth, the breathable pressure corresponding the diver's depth exerted on said sensing piston by said low pressure air flow into said low pressure side of said open interior is insufficient to overcome a pressure corresponding the air pressure from the pressurized air source exerted on said sensing piston by said high pressure air flow into said high pressure side of said open interior such that said sensing piston is maintained in said normal fill flow stopping orientation, and upon the air pressure from the pressurized air source dropping below said danger/low air level corresponding the diver's depth, the breathable pressure corresponding the diver's depth exerted on said sensing piston by said low pressure air flow into said low pressure side of said open interior is sufficient to overcome the pressure corresponding the air pressure from the pressurized air source exerted on said sensing piston by said high pressure air flow into said high pressure side of said open interior so as to result in movement of said sensing piston to said fill flow permitting orientation; and (b) a second automatic ascent control stage structured to initiate gradual, regulated inflation of the personal flotation device upon the diver's depth exceeding a preset safe depth level, said second automatic ascent control stage comprising:

a primary housing, said primary housing including an air inlet, an air outlet, and a regulator chamber, said regulator chamber including an interior flow through area, an inlet access disposed between said air inlet and said interior flow through area of said regulator chamber, displaceable valve means disposed at said inlet access and structured and disposed to move between a flow through orientation, wherein air is permitted to pass from said air inlet into said interior flow through area of said regulator chamber, and a flow prevention orientation, wherein air is prevented from passing from said air inlet into said interior flow through area of said regulator chamber, a sensing body disposed in said regulator chamber and structured to move between a valve displacing position, wherein said displaceable valve means are urged into said flow through orientation by said sensing body, and an unengaging position wherein said displaceable valve means is maintained in said flow prevention orientation, said sensing body including a compensating end and a sensor end, said sensor end being disposed in said interior flow through area of said regulator chamber, said air outlet being structured to direct air that enters said interior flow through area of said regulator chamber into the personal flotation device and to permit air squeezed out of the personal flotation device as a result of an ambient pressure corresponding the diver's depth being exerted on the personal flotation device to flow into said interior flow through area and increase a pressure therein, said sensing body being structured and disposed such that said pressure in said interior flow through area of said regulator chamber urges said sensing body into said valve displacing position, and said sensor end of said sensing body being structured to resist movement of said sensing body into said valve displacing position and to gradually compress upon said pressure in said interior flow through area of said regulator chamber exceeding a resistance air pressure such that when said ambient pressure corresponding the diver's depth reaches a predetermined depth pressure, corresponding said preset safe depth level, said sensor end is compressed sufficiently such that said sensing body is disposed in said valve displacing position.

2. A depth sensitive diver safety system as recited in claim 1 wherein said second ascent control stage further includes:

an exterior pressure area disposed in said regulator chamber wherein said compensating end of said sensing body is disposed, seal means disposed about said sensing body and structured to prevent fluid flow between said exterior pressure area of said regulator chamber and said interior flow through area of said regulator chamber, and an exterior pressure inlet disposed in said primary housing and structured to permit fluid flow into and out of said exterior pressure area of said regulator chamber upon corresponding lateral movement of said sensing body.

3. A depth sensitive diver safety system as recited in claim 1 wherein said first automatic ascent control stage further includes a piston seat disposed on said low pressure side of said open interior of said main housing, said piston seat being disposed such that when said low pressure face of said sensing piston rests on said piston seat, said sensing piston is in said fill flow stopping orientation, and said piston seat being structured to reduce a contact area on said low pressure face of said sensing piston a predetermined amount corresponding the danger/low air level at which the air pressure from the pressurized air source exerted on said sensing piston by said high pressure air flow into said high pressure side of said open interior is insufficient to resist movement of said sensing piston as a result of the breathable pressure corresponding the diver's depth exerted on said sensing piston by said low pressure air flow into said low pressure side of said open interior.

4. A depth sensitive diver safety system as recited in claim 1 wherein said sensing piston of said first automatic ascent control stage is generally T-shaped such that a contact area on said low pressure face of said sensing piston is larger than a contact face on said high pressure stem of said sensing piston.

5. A depth sensitive diver safety system as recited in claim 1 wherein said resilient material seal of said first automatic ascent control stage is statically disposed in said open interior of said main housing and is structured to materially compress in accordance with lateral movement of said sensing piston.

6. A depth sensitive diver safety system as recited in claim 5 wherein said resilient material seal of said first automatic ascent control stage includes a general "top hat" shape structured to allow linear movement of said sensing piston relative thereto while statically sealing said sensing piston off from said high pressure side of said open interior of said main housing.

7. A depth sensitive diver safety system as recited in claim 6 wherein said resilient material seal of said first automatic ascent control stage is self lubricating as a result of the lateral movement of said sensing piston therein.

8. A depth sensitive diver safety system as recited in claim 1 wherein said second automatic ascent control stage further includes a manual inflate pin disposed in said primary housing, said manual inflate pin being exteriorly actuatable and extending into said inlet access so as to engage and move said displacement valve means to said flow through orientation upon exterior actuation thereof.

9. A depth sensitive diver safety system as recited in claim 1 wherein said second automatic ascent control stage further includes an overflow valve structured and disposed to release predetermined quantities of excess air pressure from said interior flow through area of said regulator chamber which has backed up into said interior flow through area through said air outlet.

10. A depth sensitive diver safety system as recited in claim 1 wherein said displaceable valve means of said second automatic ascent control assembly includes a tilt valve extending from said air inlet, through said inlet access and into said interior flow through area of said regulator chamber for displacement engagement with said sensing body.

11. A depth sensitive diver safety system as recited in claim 1 wherein said second automatic ascent control assembly further includes a compensator spring disposed in said exterior pressure area of said regulator chamber and structured to counteract a frictional resistance force caused by said seal means, a back flow pressure, and a breaking pressure of said displaceable valve means.

12. A depth sensitive diver safety system as recited in claim 1 wherein said sensor end of said sensing body of said second automatic ascent control stage includes an airtight, fluid filled bladder filled at a sea level pressure and structured to facilitate compression thereof upon compression of a fluid therein due to increasing pressure at an increased depth.

13. A depth sensitive diver safety system to be utilized with a scuba system including: (i) at least one pressurized air source having at least one air outlet, (ii) a high/low pressure regulator secured at the air outlet of the pressurized air source so as to provide at least one high pressure air source and at least one low pressure air source, the low pressure air source being structured to supply air at a breathable pressure corresponding a diver's depth, and (iii) an inflatable personal flotation device; said depth sensitive diver safety system comprising:

(a) an automatic ascent control stage structured to initiate inflation of the personal flotation device upon an air pressure from the pressurized air source dropping to a danger/low air level corresponding the diver's depth, said automatic ascent control stage comprising:

a main housing, said main housing including a high pressure end, a low pressure end, and a surrounding side wall defining an open interior, said open interior including a high pressure side and a low pressure side, said main housing being secured to the high pressure air source at said high pressure end so as to permit high pressure air flow from said high pressure air source into said high pressure side of said open interior, said main housing being secured to the low pressure air source at said low pressure end so as to permit low pressure air flow from said low pressure air source into said low pressure side of said open interior, a filler outlet disposed in said surrounding wall of said main housing, said filler outlet being disposed in fluid flow communication between said low pressure side of said open interior of said main housing and a fill air conduit, said fill air conduit being connected in fluid flow communication with the personal flotation device such that air permitted to exit said main housing through said filler outlet gradually fills the personal flotation device resulting in an ascent by the diver, a sensing piston including a high pressure stem and a low pressure face, said sensing piston being slidably disposed within said open interior of said main housing and being structured to move between a fill flow stopping orientation, wherein air is prevented from flowing into said filler outlet, and a fill flow permitting orientation, wherein air is permitted to enter said filler outlet, a fluid impermeable, resilient material seal disposed between said sensing piston and said high pressure end, said sensing piston being disposed in said open interior of said main housing such that said low pressure air flow into said low pressure side of said open interior urges said sensing piston into said fill flow permitting orientation and said high pressure air flow into said high pressure side of said open interior urges said sensing piston to said fill flow stopping orientation, and said main housing and said sensing piston of said first automatic ascent control stage being structured such that upon the air pressure in the pressurized air tank being above said danger/low air level corresponding the diver's depth, the breathable pressure corresponding the diver's depth exerted on said sensing piston by said low pressure air flow into said low pressure side of said open interior is insufficient to overcome a pressure corresponding the air pressure from the pressurized air source exerted on said sensing piston by said high pressure air flow into said high pressure side of said open interior such that said sensing piston is maintained in said normal fill flow stopping orientation, and upon the air pressure from the pressurized air source dropping below said danger/low air level corresponding the diver's depth, the breathable pressure corresponding the diver's depth exerted on said sensing piston by said low pressure air flow into said low pressure side of said open interior is sufficient to overcome the pressure corresponding the air pressure from the pressurized air source exerted on said sensing piston by said high pressure air flow into said high pressure side of said open interior so as to result in movement of said sensing piston to said fill flow permitting orientation.

14. A depth sensitive diver safety system as recited in claim 13 further including a replaceable piston seat disposed on said low pressure side of said open interior of said main housing, said piston seat being disposed such that when said low pressure face of said sensing piston rests on said piston seat, said sensing piston is in said fill flow stopping orientation, and said piston seat being structured to reduce a contact area on said low pressure face of said sensing piston a predetermined amount corresponding the danger/low air level at which the air pressure from the pressurized air source exerted on said sensing piston by said high pressure air flow into said high pressure side of said open interior is insufficient to resist movement of said sensing piston as a result of the breathable pressure corresponding the diver's depth exerted on said sensing piston by said low pressure air flow into said low pressure side of said open interior.

15. A depth sensitive diver safety system as recited in claim 13 wherein said sensing piston is generally T-shaped such that a contact area on said low pressure face of said sensing piston is larger than a contact face on said high pressure stem of said sensing piston.

16. A depth sensitive diver safety system as recited in claim 13 wherein said resilient material seal is statically disposed in said open interior of said main housing and is structured to materially compress in accordance with lateral movement of said sensing piston.

17. A depth sensitive diver safety system as recited in claim 16 wherein said resilient material seal includes a general "top hat" shape structured to allow linear movement of said sensing piston relative thereto while statically sealing said sensing piston off from said high pressure side of said open interior of said main housing.

18. A depth sensitive diver safety system to be utilized with a scuba system including: (i) at least one pressurized air supply having at least one air outlet, (ii) a pressure regulator secured at the air outlet of the pressurized air tank so as to provide at least one low pressure air source, the low pressure air source being structured to supply air at a breathable pressure corresponding a diver's depth, and (iii) an inflatable personal flotation device; said depth sensitive diver safety system comprising:

(a) an automatic ascent control stage structured to initiate gradual, regulated inflation of the personal flotation device upon the diver's depth exceeding a preset safe depth level, said automatic ascent control stage comprising:

a primary housing, said primary housing including an air inlet, an air outlet, and a regulator chamber, said regulator chamber including an interior flow through area, an inlet access disposed between said air inlet and said interior flow through area of said regulator chamber, displaceable valve means disposed at said inlet access and structured and disposed to move between a flow through orientation, wherein air is permitted to pass from said air inlet into said interior flow through area of said regulator chamber, and a flow prevention orientation, wherein air is prevented from passing from said air inlet into said interior flow through area of said regulator chamber, a sensing body disposed in said regulator chamber and structured to move between a valve displacing position, wherein said displaceable valve means are urged into said flow through orientation by said sensing body, and an unengaging position wherein said displaceable valve means is maintained in said flow prevention orientation, said sensing body including a compensating end and a sensor end, said sensor end being disposed in said interior flow through area of said regulator chamber, said air outlet being structured to direct air that enters said interior flow through area of said regulator chamber into the personal flotation device and to permit air squeezed out of the personal flotation device as a result of an ambient pressure corresponding the diver's depth being exerted on the personal flotation device to flow into said interior flow through area and increase a pressure therein, said sensing body being structured and disposed such that said pressure in said interior flow through area of said regulator chamber urges said sensing body into said valve displacing position, and said sensor end of said sensing body being structured to resist movement of said sensing body into said valve displacing position and to gradually compress upon said pressure in said interior flow through area of said regulator chamber exceeding a resistance air pressure such that when said ambient pressure corresponding the diver's depth reaches a predetermined depth pressure, corresponding said preset safe depth level, said sensor end is compressed sufficiently such that said sensing body is disposed in said valve displacing position.

19. A depth sensitive diver safety system as recited in claim 18 wherein said automatic ascent control stage further includes a manual inflate pin disposed in said primary housing, said manual inflate pin being exteriorly actuatable and extending into said inlet access so as to engage and move said displacement valve means to said flow through orientation upon exterior actuation thereof.

20. A depth sensitive diver safety system as recited in claim 18 wherein said displaceable valve means includes a tilt valve extending from said air inlet, through said inlet access and into said interior flow through area of said regulator chamber for displacement engagement with said sensing body.

21. A depth sensitive diver safety system as recited in claim 18 wherein said sensor end of said sensing body includes an airtight, fluid filled bladder filled at a sea level pressure and structured to facilitate compression thereof upon compression of a fluid therein due to increasing pressure at an increased depth.

22. A depth sensitive diver safety system as recited in claim 18 further including:

an exterior pressure area disposed in said regulator chamber wherein said compensating end of said sensing body is disposed, seal means disposed about said sensing body and structured to prevent fluid flow between said exterior pressure area of said regulator chamber and said interior flow through area of said regulator chamber, and an exterior pressure inlet disposed in said primary housing and structured to permit fluid flow into and out of said exterior pressure area of said regulator chamber upon corresponding lateral movement of said sensing body.

* * * * *